United States Patent [19]

Roccaforte

[11] 4,284,193

[45] Aug. 18, 1981

[54] BOUTIQUE CARTON AND CARTON BLANK

[75] Inventor: Harry I. Roccaforte, Western Springs, Ill.

[73] Assignee: Champion International Corporation, Stamford, Conn.

[21] Appl. No.: 108,532

[22] Filed: Dec. 31, 1979

[51] Int. Cl.[3] ..... B65D 5/16; B65D 5/54

[52] U.S. Cl. ..... 206/45.31; 206/620; 229/160

[58] Field of Search ..... 206/45.31, 45.34, 604, 206/620–625; 229/160

[56] References Cited

U.S. PATENT DOCUMENTS

| | | | |
|---|---|---|---|
| 1,649,452 | 11/1927 | De Clercq | 206/45.31 X |
| 2,007,520 | 7/1935 | Daller | 206/622 |
| 2,018,707 | 10/1935 | Daller | 206/45.31 |
| 2,053,700 | 9/1936 | Codere | 206/45.31 |
| 2,097,858 | 11/1937 | Herz | 206/45.31 |
| 2,311,137 | 2/1943 | Sunderhauf et al. | 206/45.31 X |
| 2,672,274 | 3/1954 | Crane | 206/45.31 X |
| 3,155,273 | 11/1964 | Cote | 206/45.31 X |
| 3,219,253 | 11/1965 | Davis | 206/45.31 X |
| 3,484,036 | 12/1969 | Meyers | 206/624 X |
| 3,640,449 | 2/1972 | Bastian | 206/621 X |

FOREIGN PATENT DOCUMENTS

| | | | |
|---|---|---|---|
| 2224236 | 11/1973 | Fed. Rep. of Germany | 206/45.31 |
| 1194771 | 11/1959 | France | 229/169 |
| 91528 | 2/1938 | Sweden | 206/45.31 |

*Primary Examiner*—Stephen Marcus

*Attorney, Agent, or Firm*—Evelyn M. Sommer

[57] ABSTRACT

An erected paperboard carton includes a covering member which is removable by the customer to form a "boutique" carton, i.e., a decorated carton without advertising matter. The covering member is a removable covering panel overlying a top panel of the carton and connected, by a tear line, to the carton body. The covering panel is connected, by a fold line, to a lift panel having side flaps with severable "S" cuts.

8 Claims, 5 Drawing Figures

BOUTIQUE CARTON AND CARTON BLANK

BACKGROUND OF THE INVENTION

1. Field of the Invention

The present invention relates to cartons and more particularly to a carton having a covering which may be removed by the customer so that the carton may be displayed.

At the present time some types of cartons, sometimes called "boutique" cartons, have removable covering members which permit the customer to uncover the carton. One such carton covering is a thin plastic cover which completely envelops the carton and which has the product name, or advertising matter, printed on its surface. The customer removes the plastic covering, exposing the carton underneath. The carton may be printed with a decorative design and without product advertising or the product name.

Another type of carton which obtains a similar result utilizes a covering panel which is adhered to the top of the carton. The customer tears off the adhered panel, exposing the decorative top. This type of carton, however, frequently presents difficulties in removing the adhered covering panel and the customer may leave portions of the panel adhering in an unsightly manner to the top of the carton.

Both of these alternatives are relatively expensive and present the user with a relatively cumbersome method of exposing the underlying decorated carton.

SUMMARY AND OBJECTIVES OF THE INVENTION

In accordance with the present invention a boutique carton is presented in which a paperboard covering panel overlies the top panel of the carton. The overlying panel is removably secured to an end panel by a score (tear) line and is connected to a panel (lift panel) which lies flat against an end panel and is adapted to be lifted by the customer. The lift panel has side flaps having "S" cuts, so that the side flaps are readily severed upon lifting the lift panel and the lift panel lies flat on its end panel until lifted away by the customer.

It is an objective of the present invention to provide a carton in which the customer may conveniently remove a covering panel to expose the underlying boutique carton.

It is another objective of the present invention to provide a carton with a covering panel which, after removal of the covering panel, will attain an attractive appearance.

It is another objective of the present invention to provide such a carton which is relatively low in cost and which may be manufactured using conventional paperboard carton manufacturing techniques and facilities.

It is a further objective of the present invention to provide a one piece carton blank which may be shipped flat and then erected to form such a carton.

BRIEF DESCRIPTION OF THE DRAWINGS

Other objectives and advantages of the present invention will be apparent from the following detailed description of a preferred embodiment and the claims, the description being taken in conjunction with the accompanying drawings.

In the drawings.

DETAILED DESCRIPTION OF THE PREFERRED EMBODIMENT

Figure 1:
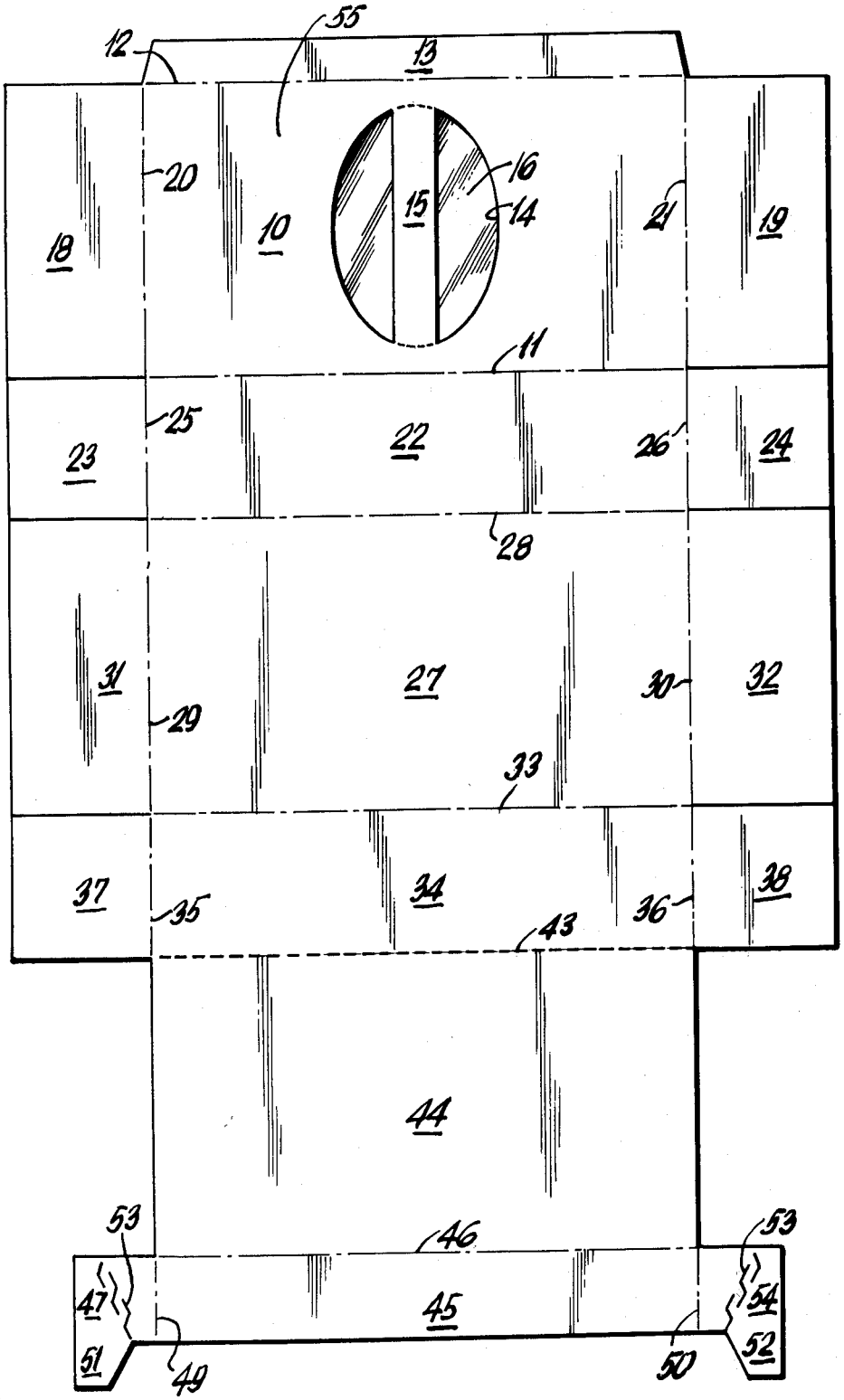
FIG. 1 is a top plan view of the carton blank of the present invention which, when erected, forms a carton as shown in FIGS. 2–4 and in which the dash lines represent score lines and the dot-dash lines represent fold lines.

As shown in FIG. 1, the blank of the present invention may be die-cut from paperboard using conventional manufacturing methods. The blank is a one-piece blank and is used without additional pieces to form a carton of the present invention.

The blank comprises a first rectangular panel 10 having opposite fold lines 11 and 12. An adhesive end panel 13 having an exterior glue face is connected to the top panel 10 along the fold line 12. The top panel 10 has an oval opening 14 through which the goods within the carton may be viewed. The opening 14, although shown as an oval, may alternatively be of other forms; for example, it may be circular, rectangular and may have one (or more) removable cross-struts 15. The opening 14 is backed by a sheet of transparent material 16 which is adhered to the underside of the top panel 10. The sheet 16 has an elongated slot (not shown), underneath strut 15, through which the goods may be removed by the user. For example, the goods may be tissues or swabs.

A first side flap 18 and a second side flap 19 are connected to the top panel 10 along the respective fold lines 20 and 21. The top panel 10 is connected to an end panel 22 by means of the fold line 11. The end panel 22 is connected to respective side flaps 23,24 by respective fold lines 25 and 26. The end panel 22 is connected to the bottom panel 27 along its fold line 28.

The bottom panel 27 is a rectangular panel having the same size and shape as the top panel 10. The bottom panel 27 has opposite fold lines 29 and 30 which connect the bottom panel 27 to its respective side flaps 31 and 32.

The bottom panel 27 is connected, along its fold line 33, to the second end panel 34. The second end panel is rectangular and of the same size and shape as the first end panel 22. The second end panel has opposite respective fold lines 35 and 36 which connect the second side panel to its respective side flaps 37 and 38. In this embodiment the side flaps 37,38 and 23,24 are rectangular and of the same size and shape and the side flaps 31,32 and 18,19 are of the same size and shape.

The second end panel 34 is connected by a tear line (score line) 43 to an overlying panel (fifth panel) 44. The overlying panel 44 is rectangular and of the same width, as indicated by direction W, as the top panel 10. The length of the overlying panel 44, which length is perpendicular to the direction W, is slightly greater than the length of the top panel 10. The overlying panel 44, after the carton is erected lies on top of the top panel 10 but is not adhered to that panel. The top face of the overlying panel 44 has advertising, or other printed material, which the customer may wish to remove so as not to detract from the appearance of the carton. The tear line 43 is adapted to be severed by the customer in order to remove the overlying panel 44.

The overlying panel 44 is connected to the lift panel (sixth panel) 45 along a fold line 46. The lift panel 45 at its free edge 47 may be straight, or it may have a crescent indentation, which permits the fingers of the user to catch hold of the lift panel 45. The lift panel 45 is connected, by respective fold lines 49 and 50, to its respective side flaps 51 and 52. Each of the side flaps 51 and 52 have a plurality of "S" cuts 53 which allow the side flaps 51,52 to be severed and also permit the lift panel 45 to lie relatively flat against the first end panel 22 after the carton has been erected. The inside face of the side flaps 51,52 at their outer portions 47,54 have a suitable adhesive which adheres them to the respective side flaps 23,24.

Figure 2:
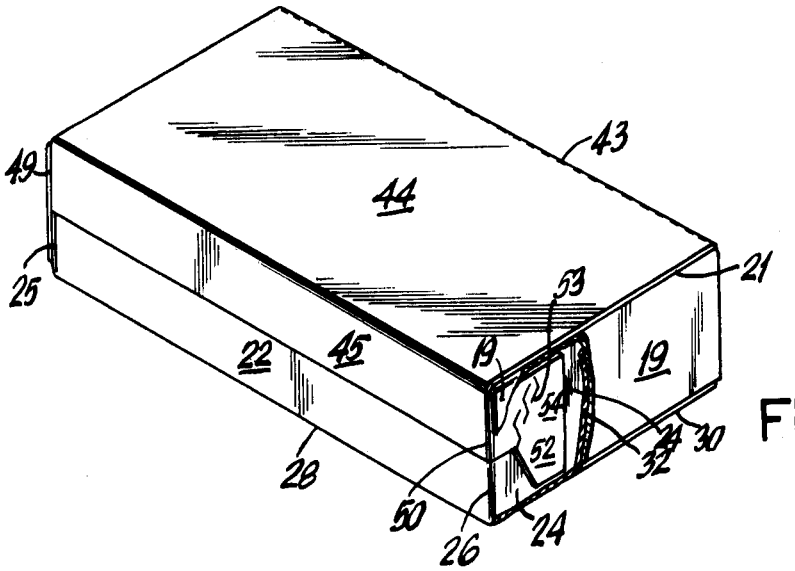
FIG. 2 is a perspective view of the carton of the present invention with the carton closed and the covering panel in place.

FIG. 2 shows a blank after it has been partially glued, for example, for shipment, but before it has been erected for use. The carton is partially glued by adhering the adhesive face of the adhesive panel 13 to the inner face of the second end panel 34. This places the tear line 43 parallel and above the fold line 12. In addition, the adhesive portions of the respective flaps 51,52 are adhered to their respective side flaps 23 and 24. This places the fold line 46 above and parallel to the fold line 11. For shipment, the carton blank, which has now been partially glued together, may be, as shown in FIG. 2, in a flat state.

The carton may be partially erected by the manufacturer before the contents are inserted. Once the contents are inserted the cartons may then be sealed.

The carton may be erected by placing the end panels 22,34 at right angles to the top 10 and bottom 27 panels. Then the side flaps 23 and 37 panels. The other side panels 18 and 31 are then folded inwardly and the outer face of flap 18 adhered to the inner face of the flap 31. The contents may then be inserted and the same procedure followed on the opposite side of the carton. In this instance the side flaps 24 and 38 will be folded inwardly at right angles to the top panel 10 and the bottom panel 27. Subsequently the side flaps 19 and 32 will be folded inwardly at right angles to the top panel 10 and the bottom panel 27. Subsequently the side flaps 19 and 32 will be folded inwardly at right angles to their end panels and the outer face of flap 19 adhered to the inner face of flap 32.

Figure 3:
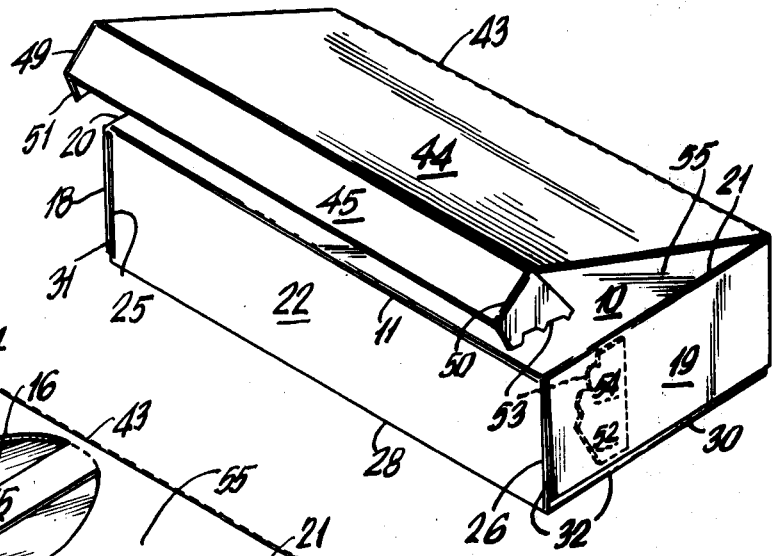
FIG. 3 is a perspective view of the carton of the present invention in which the covering panel is partially lifted and in the process of being removed.
Figure 4:
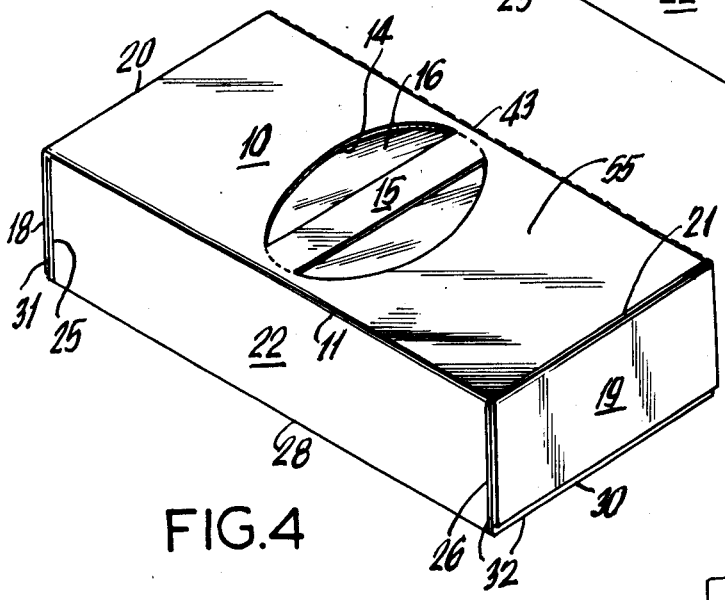
FIG. 4 is a perspective view of the cartons of FIGS. 2 and 3 but with the protective panel completely removed.
Figure 5:
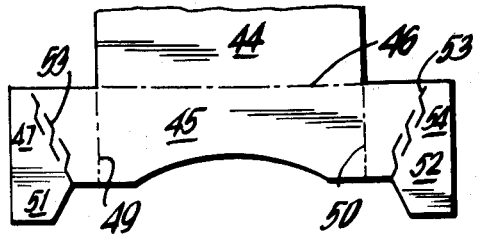
FIG. 5 is a top plan view of an alternative lift panel for use in the present invention.

After the carton has been completely erected and shipped to the final user, as illustrated in FIG. 3, the user may remove the overlying panel 44. He accomplishes such removal by holding the edge of the lift panel 45 and pulling panel 45 outwardly from the first end panel 22. This severs the flaps 51,52 along the "S" cuts 53. He then lifts the overlying panel 44 away from the top panel 10 and severs it from the carton by tearing along the tear line 43. This exposes the outer face 55 of the top panel 10 and permits the user to remove the contents. The outer face 55 may be decorated in a pleasing motif, for example, flowers or geometric designs, which may be similar or complementary to the design on the other exposed faces of the carton. The user now has a carton, as shown in FIG. 4, in which the overlying panel, containing advertising or the name of a product, has been removed.

What is claimed is:

1. An erected carton comprising a plurality of rectangular body panels including a top panel having an opening therethrough, a first end panel, a bottom panel and a second end panel all hingedly connected in the named sequence and each folded at a right angle to its connected panel; an adhesive end panel hingedly connected at a right angle to said top panel and adhered to the interior face of the said second end panel;

a plurality of pairs of side flaps connected to each of the said body panels to form a closed container, the side flaps of each pair being connected by a hinged fold line at a right angle on opposite sides of a body panel;

an overlying panel hingedly connected by a tear line to the second end panel and overlying the said top panel;

a lift panel hingedly connected at a right angle to said overlying panel at a fold line parallel and opposite to said tear line; said lift panel overlying at least a portion of the exterior face of said first end panel;

first and second lift panel side flaps hingedly connected at opposite ends to said lift panel;

said lift panel side flaps each having a weakened line and each being fastened to a first end panel side flap beyond said weakened line, wherein upon use said top panel may be exposed by lifting said lift panel, tearing the lift panel side flap tear lines, disengaging said lift panel, continuing to lift the lift panel to thereby lift said overlying panel, and tearing away said overlying panel along its weakened line to expose the exterior face of said top panel.

2. An erected carton as in claim 1 wherein a sheet of flexible plastic material is adhered to the back of said top panel to at least partially cover said top panel opening.

3. An erected carton as in claim 2 wherein said plastic material has a slit centered within said top panel opening.

4. An erected carton as in claim 1 wherein said lift panel weakened lines are formed by "S" slits.

5. An erected carton as in claim 1 wherein said lift panel has a crescent form free edge.

6. An erected carton comprising a plurality of body panels including an adhesive end panel, a top panel, a first end panel, a bottom panel and a second end panel all hingedly connected in the named sequence and each folded at a right angle to its connected panel; the said adhesive end panel being adhered to the interior face of the said second end panel;

a plurality of body panel side flaps connected to the said body panels to form a closed container;

a fifth panel hingedly connected by a tear line to the second end panel and overlying the said top panel;

a sixth panel hingedly connected at a right angle to said fifth panel at a fold line parallel and opposite to said tear line; said sixth panel overlying at least a portion of the exterior face of said first end panel;

first and second sixth panel side flaps hingedly connected at opposite sides to said sixth panel; and sixth panel side flaps each having a line formed by a plurality of "S" slits and each being fastened to a body panel side flap beyond said tear line, wherein upon use said top panel may be exposed by lifting said sixth panel, tearing the sixth panel side flap tear lines, disengaging said sixth panel, continuing to lift the sixth panel to thereby lift said fifth panel, and tearing away said fifth panel along its tear line to expose the exterior face of said top panel.

7. A one-piece paperboard carton blank which is partially glued together and is flat, comprising a plurality of body panels including an adhesive end panel, a rectangular top panel a rectangular first end panel, a rectangular bottom panel of the same size as the top panel, and a second rectangular end panel of the same size as the first end panel, all hingedly connected in the named sequence; the said adhesive end panel being adhered to the second end panel;

a plurality of body panel side flaps connected to the said body panels including a pair of opposite first end panel side flaps;

a rectangular fifth panel hingedly connected by a tear line to the second end panel with the tear line overlying said tear line being parallel to the fold line between said top panel and said adhesive end panel, said fifth panel overlying said top panel and not being adhered thereto;

a sixth panel hingedly connected to said fifth panel at a fold line parallel and opposite to said tear line; said sixth panel overlying at least a portion of the exterior face of said first end panel;

first and second sixth panel side flaps hingedly connected at opposite sides to said sixth panel;

said sixth panel side flaps each having a weakened line and each being fastened to a side flap of said first end panel beyond said tear line.

8. A carton blank as in claim 7 wherein the weakened lines in the said sixth panel side flaps are formed by aligned "S" slits.

* * * * *